US009067224B2

(12) United States Patent
Albrecht et al.

(10) Patent No.: US 9,067,224 B2
(45) Date of Patent: Jun. 30, 2015

(54) NOZZLE ARRANGEMENT

(75) Inventors: Markus Albrecht, Abstatt (DE); Frank Hamscher, Fellbach (DE)

(73) Assignee: EISENMANN AG, Boeblingen (DE)

( * ) Notice: Subject to any disclaimer, the term of this patent is extended or adjusted under 35 U.S.C. 154(b) by 215 days.

(21) Appl. No.: 13/500,354

(22) PCT Filed: Sep. 29, 2010

(86) PCT No.: PCT/EP2010/005921

§ 371 (c)(1),
(2), (4) Date: May 23, 2012

(87) PCT Pub. No.: WO2011/042129

PCT Pub. Date: Apr. 14, 2011

(65) Prior Publication Data

US 2012/0234234 A1 Sep. 20, 2012

(30) Foreign Application Priority Data

Oct. 9, 2009 (DE) ..... 10 2009 048 899

(51) Int. Cl.

| | |
|---|---|
| ***B05B 13/06*** | (2006.01) |
| ***B05B 1/16*** | (2006.01) |
| ***B05B 15/02*** | (2006.01) |
| *B05B 7/26* | (2006.01) |
| *B05B 13/04* | (2006.01) |

(52) U.S. Cl.

CPC ..... *B05B 1/1636* (2013.01); *B05B 7/262* (2013.01); *B05B 13/0431* (2013.01); *B05B 13/0627* (2013.01); *B05B 15/0258* (2013.01)

(58) Field of Classification Search

CPC ..... B05B 13/0627; B05B 13/06; B05B 3/10
USPC ..... 118/306, 317, 321, 323; 239/223, 224, 239/220, 390–397, 601; 427/233, 236
See application file for complete search history.

(56) References Cited

U.S. PATENT DOCUMENTS

| | | | | |
|---|---|---|---|---|
| 1,612,326 | A | 12/1926 | Herbert | |
| 2,647,014 | A | 7/1953 | Edwards | |
| 3,044,441 | A * | 7/1962 | Blakeslee et al. | 118/317 |
| 3,227,375 | A | 1/1966 | Ziebart | |
| 3,377,028 | A | 4/1968 | Bruggeman | |
| 3,697,313 | A * | 10/1972 | Stumphauzer et al. | 427/233 |
| 4,272,567 | A * | 6/1981 | Blakeslee | 427/236 |
| 5,211,335 | A | 5/1993 | Strid | |
| 6,053,434 | A | 4/2000 | Filipsson | |
| 6,554,212 | B2 | 4/2003 | Borcea et al. | |
| 7,360,721 | B2 | 4/2008 | Hofer | |
| 2008/0022450 | A1 | 1/2008 | Tsai | |
| 2011/0052806 | A1 * | 3/2011 | Kosovich et al. | 427/233 |

FOREIGN PATENT DOCUMENTS

| | | |
|---|---|---|
| DE | 22 63 266 A1 | 7/1974 |
| DE | 25 26 702 A1 | 12/1976 |

(Continued)

*Primary Examiner* — Yewebdar Tadesse
(74) *Attorney, Agent, or Firm* — Factor Intellectual Property Law Group, Ltd.

(57) ABSTRACT

A nozzle arrangement for applying coating material in cavities of objects, in particular of vehicle bodies, comprises a nozzle element, which can be connected to a material source and comprises a first discharge opening and at least one further discharge opening, by way of which coating material can be discharged. With a directing device, the flow path of the coating material from the material source can be set in such a way that the flow path leads optionally to the first discharge opening and/or to the at least one further discharge opening.

14 Claims, 8 Drawing Sheets

(56) References Cited

FOREIGN PATENT DOCUMENTS

| | | | |
|---|---|---|---|
| DE | 32 30 247 | A1 | 2/1984 |
| DE | 696 26 114 | T2 | 11/2003 |
| DE | 102 57 783 | B3 | 3/2004 |
| DE | 103 20 856 | B3 | 9/2004 |
| DE | 10 2004 046 351 | A1 | 3/2006 |
| FR | 1 280 937 | A | 1/1962 |

* cited by examiner

NOZZLE ARRANGEMENT

RELATED APPLICATIONS

This application claims the filing benefit of International Patent Application No. PCT/EP2010/005921, filed Sep. 29, 2010, which claims the filing benefit of German Patent Application No. 10 2009 048 899.5 filed Oct. 9, 2009, the contents of both of which are incorporated herein by reference.

TECHNICAL FIELD AND BACKGROUND OF THE INVENTION

The invention relates to a nozzle arrangement for applying coating material to cavities in articles, in particular vehicle bodies, having a nozzle element which may be connected to a material source, a first dispensing opening and at least one further dispensing opening through which coating material may be dispensed.

A nozzle arrangement of this kind is known for example from U.S. Pat. No. 6,554,212 B2 and is used in particular to line cavities in vehicle bodies with an anticorrosion wax. For this purpose, the nozzle element typically takes the form of an elongate nozzle lance whereof the free end has a plurality of dispensing openings. The nozzle lance is guided by means of an arm of a multiple-axis application robot and, for application, is pushed into a cavity for treatment in the vehicle body such that the region of the nozzle lance having the dispensing openings is in the interior of the cavity. Where necessary application may also be performed manually.

A vehicle body has up to 120 cavities which may have markedly differing geometries. However, it must be ensured that all the different cavities are lined with wax completely and reliably to ensure satisfactory corrosion protection. To this end, different nozzle elements are each used for different cavity types. These are adapted in respect of their shape, number and the arrangement of the respectively associated dispensing openings to a respective particular cavity type in a particular vehicle body, with the result that wax can be sprayed into the cavities at the appropriate dispensing angles and at the appropriate dispensing locations. In this case, cavities of different geometries may be associated with a cavity type. Depending on the vehicle body for treatment, up to 80 different nozzle elements may be needed for cavity protection.

So that at least a few different cavity types may be treated using one and the same nozzle arrangement, the nozzle arrangement of U.S. Pat. No. 6,554,212 B2, for example, is set up as a changeable head and includes a plurality of different nozzle elements which, as needed, are brought into an application position by means of a folding mechanism and are thereby connected to the material source.

A flowable mixture of compressed air and wax is generated, in a manner known per se, in a mixing chamber upstream of the respectively active nozzle lance and is conveyed to the dispensing openings of the active nozzle lance and there applied to the cavity through all the dispensing openings at the same time.

The mechanical construction of this kind of changeable head having a folding mechanism is very complex, however, and also relatively susceptible to disruption. For example, the nozzle elements must not be folded into position too rapidly, since a nozzle element may be bent by the momentum of abutting contact, that is to say when it takes up its application position. Moreover, the procedure of folding into place takes a relatively long time; changing from a first nozzle element to a second nozzle element typically takes 3 to 4 seconds. This restricts the number of vehicle bodies treated per unit of time and thus limits the rate of operation of the treatment plant.

Moreover, it is necessary constantly to check whether the nozzle element to be used is correctly locked in its application position and the other nozzle elements are correctly locked in their respective inactive positions. If this is not the case, there may be undesirable collisions between the nozzle elements and the vehicle body.

Further, the overall space needed for the folding mechanism is very large by comparison with the dimensions of the nozzle elements. This restricts the ability to reach cavities, in particular in the interior of the vehicle body.

During operation, the nozzle elements are soiled by wax adhering to the outside, and so have to be cleaned after a certain period of operation. For this, typically the changeable head must be removed from the robot arm and cleaned separately, at another location. So that continuous operation can be maintained even while the changeable head is being cleaned, a changeable head of the same construction, used to replace the changeable head that is to be cleaned, must be provided. This in turn has an effect on overall operating costs.

It is the object of the invention to provide a nozzle arrangement of the type mentioned at the outset which takes account of the considerations discussed above.

SUMMARY OF THE INVENTION

This object may be achieved in the case of a nozzle arrangement of the type mentioned at the outset, in that a directing means is provided by means of which the flow path of the coating material from the material source is adjustable such that the flow path leads optionally to the first dispensing opening and/or the at least one further dispensing opening.

In contrast to the case of known nozzle arrangements, according to the invention the coating material can thus be applied optionally and hence in targeted manner by way of one or more particular dispensing openings in the nozzle element. Thus, one and the same nozzle element can have a plurality of dispensing openings, of which only some are used for a first cavity type and others are used for a second cavity type, and so on. In this case, one and the same dispensing opening can be used for a plurality of different cavities, where appropriate in combination with respectively other, further dispensing openings and dispensing pressures.

In the simplest variant, there are for example two dispensing openings provided in one and the same nozzle element. Coating material may be dispensed through the first dispensing opening into a cavity of a first type, in that the directing means directs the coating material to the first dispensing opening accordingly. When a cavity of a second type is to be provided with coating material, the coating material is directed to the second dispensing opening by way of the directing means. Depending on the cavity type, it may be necessary for the application to be performed at different locations in the cavity.

As a result, one and the same nozzle element can be used for different cavity types without the nozzle element needing to be replaced. This increases the rates of operation, which is reflected in a higher level of efficiency of the coating procedure and hence in lower operating costs.

Advantageous further developments are indicated below.

It is favourable if the directing means is a directing body which is arranged in the interior of the nozzle element and defines at least one flow channel and, depending on its position or location, establishes different flow paths for the coating material. A directing body of this kind is not greatly susceptible to mechanical disruption, being a compact one-part component.

Advantageously, the directing body is borne to be turnable about an axis of rotation. Technically, it is a relatively simple matter to effect a turn for the purpose of altering the flow path.

For this purpose, the directing body may for example be coupled to a rotary shaft which extends at least in certain regions in the interior of the nozzle element. Thus, overall a compact nozzle element is formed whereof the size of the external contour is not affected by components that adjust the flow path.

It may be favourable if the rotary shaft is flexible at least in certain regions.

It is further advantageous if the nozzle element defines a charging space to which coating material may be fed and which communicates with the directing means. In this way, the interior of the nozzle element may be utilised, and lines lying along the outside of the nozzle element may be dispensed with.

If the nozzle element is an elongate nozzle lance, the latter may be introduced deep into cavities and thus efficient application of coating material may be performed. Preferably, the dispensing openings are provided at the free end—that is to say the tip—of the nozzle lance.

It has proved favourable if the nozzle lance is rectilinear.

As an alternative, the nozzle lance may be curved. This shape may be advantageous for particular cavity types. In particular, with a curved nozzle lance, the flexible rotary shaft mentioned above is useful if a rotary shaft is used.

The nozzle arrangement is made more versatile if the dispensing openings are constructed such that the coating material may be dispensed from the nozzle element in different principal directions.

In practice, good coating results have been achieved using at least one dispensing opening having a circular cross section.

Moreover, it is advantageous if at least one dispensing opening has an elliptical, rectangular, square, triangular, five-sided or hexagonal cross section or a cross section having more than six sides.

It is also possible for at least one of the dispensing openings to be slot-shaped or to take the form of an elongate hole.

The nozzle element may further be adapted to a vehicle body for treatment in that at least two dispensing openings having different cross sections are joined into a combined dispensing opening. A combined dispensing opening of this kind may for example have the shape of a keyhole. In this case, a first dispensing opening having a circular cross section is joined to a second dispensing opening having a triangular cross section.

Further, the nozzle arrangement may be matched individually to particular cavity types in that the dispensing openings have different cross sections.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail below with reference to the drawings, in which.

DETAILED DESCRIPTION OF THE PRESENT INVENTION

Figure 1:
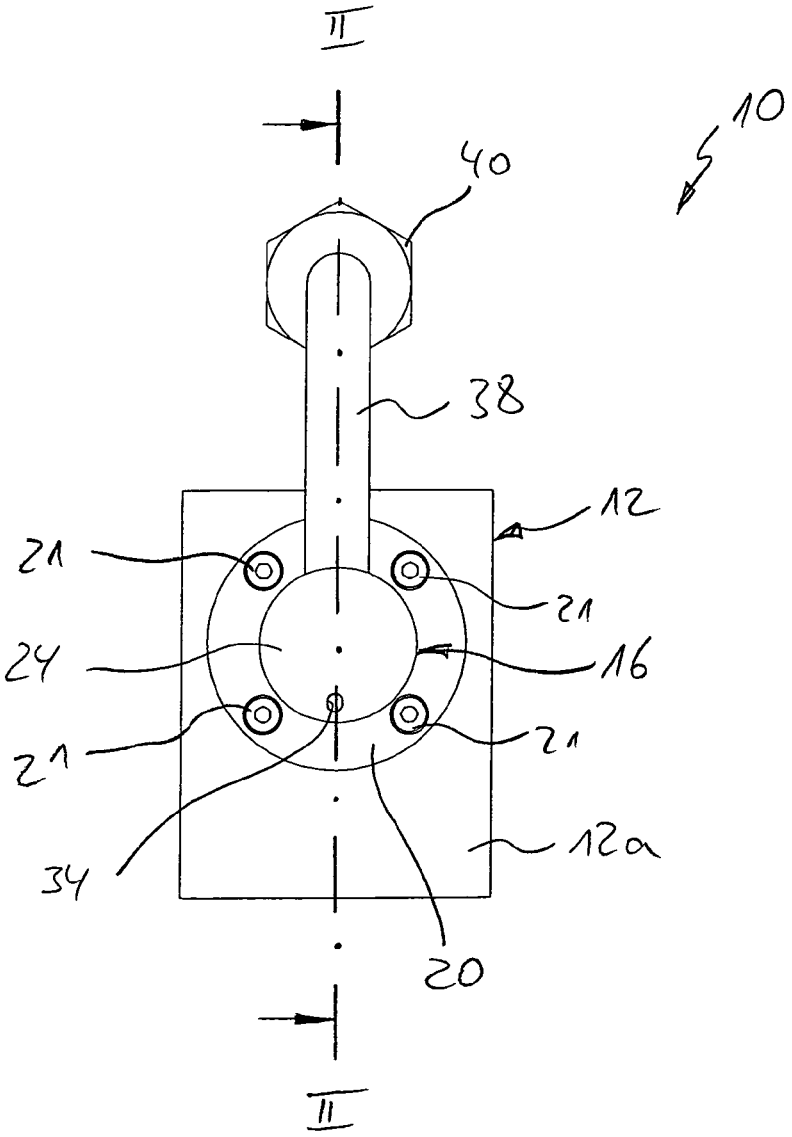
FIG. 1 shows a plan view of a head portion of a first exemplary embodiment of a nozzle arrangement having a rectilinear nozzle lance.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
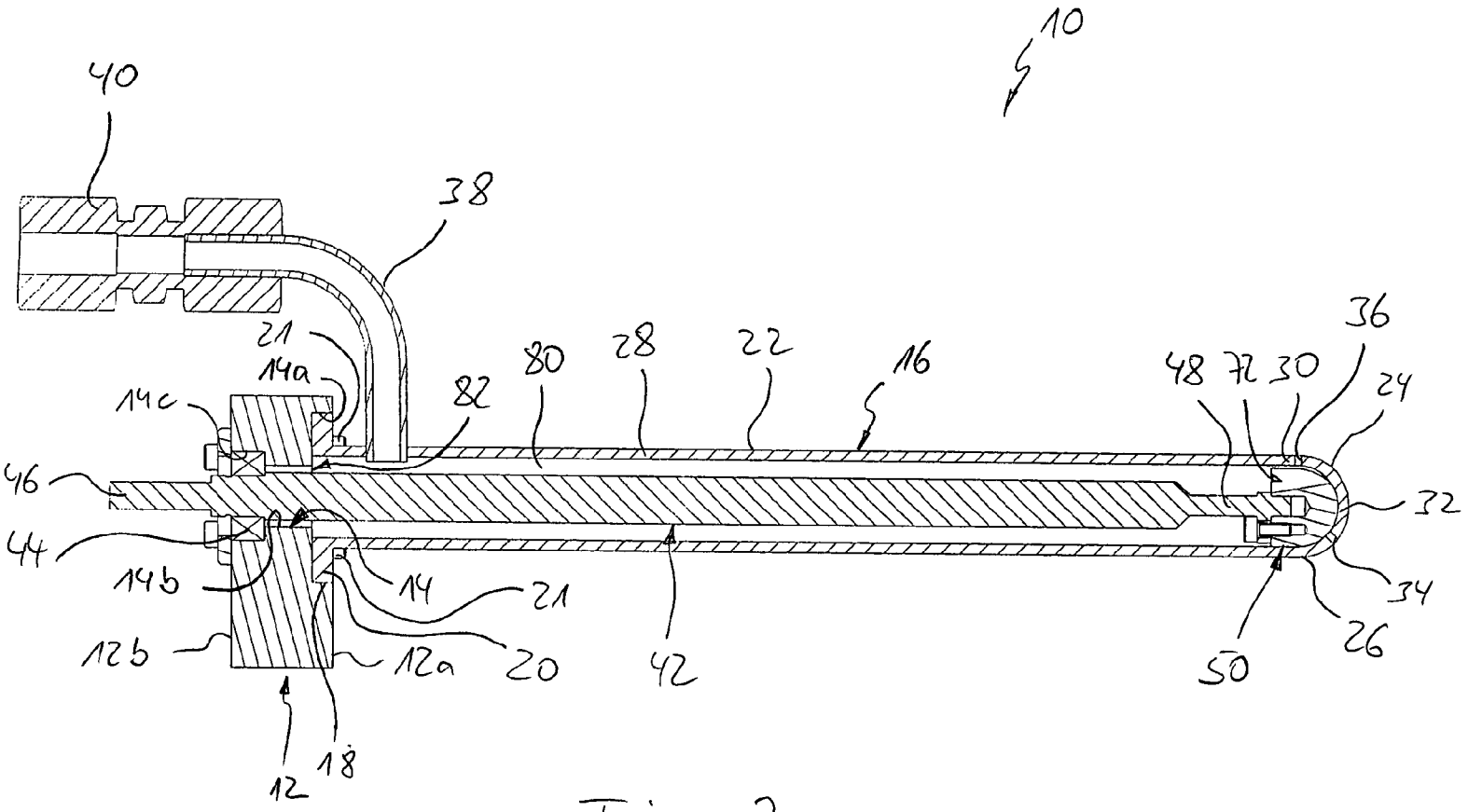
FIG. 2 shows a section through the nozzle arrangement of FIG. 1 along the line of section II-II there, wherein a directing body is shown in a first position.

Reference will first be made to FIGS. 1 and 2. There, 10 designates overall a nozzle arrangement by means of which an anticorrosion wax may be applied to cavities in vehicle bodies.

The nozzle arrangement 10 includes a bearing block 12 having two opposing and mutually parallel outer faces 12*a*, 12*b*. A stepped through bore 14 extends through the bearing block 12, perpendicular to the outer faces. Starting from the outer face 12*a* and looking in the direction of the outer face 12*b*, the through bore 14 includes three portions 14*a*, 14*b*, 14*c* which each have a circular cross section but are of different diameters. Here, the portion 14*a* has the largest diameter, the middle portion 14*b* has the smallest diameter and the portion 14*c* has a diameter in between these.

The nozzle arrangement 10 further includes a cylindrical nozzle lance 16. The latter includes, at an axially open securing end 18, a securing flange 20 running in the peripheral direction. The securing flange 20 is inserted into the portion 14*a* of the through bore 14 in the bearing block 12, this portion 14*a* having a diameter complementary to the securing flange 20 and a depth suitable therefor. The nozzle lance 16 is detachably secured to the bearing block 12 by means of screws 21. The nozzle lance 16 is arranged coaxially overall in relation to the through bore 14 in the bearing block 12.

The nozzle lance 16 includes a shaft portion 22 which extends from the securing flange 20 at the securing end 18 to a head portion 24 at the dispensing end 26 of the nozzle lance 16, which is remote from the securing end 18.

The shaft portion 22 of the nozzle lance 16 is formed by a cylindrical housing wall 28. Adjoining this at the dispensing end 26 of the nozzle lance 16 is a wall portion 30, also cylindrical, of the head portion 24 which for its part merges into a hemispherical end wall 32 of the head portion 24. The nozzle lance 16 is made in one piece overall. As a variant, the head portion 24 may also be detachably connected to the shaft portion 22 of the nozzle lance 16, however, for example by a thread-type connection.

In the present exemplary embodiment, the end wall 32 of the head portion 24 of the nozzle lance 16 has two dispensing openings 34 and 36 of circular cross section. The two dispensing openings 34 and 36 are thus provided in one and the same nozzle lance 16. The longitudinal axis of the first dispensing opening 34 extends at an angle of 45° to the longitudinal axis of the nozzle lance 16, whereas the longitudinal axis of the second dispensing opening 36 extends at a right angle to the longitudinal axis of the nozzle lance 16.

Close to the securing flange 20, a feed line 38, which has a connection point 40 at its end remote from the nozzle lance 16, passes through the housing wall 28. The feed line 38 may be connected by way of this connection point 40 to a material source (not itself shown here) in the form of a mixing chamber in which a mixture of compressed air and wax may be generated in a manner known per se, this mixture then being conveyed into the interior of the nozzle lance 16 by way of the feed line 38.

The nozzle arrangement 10 includes a rotary shaft 42 which has a circular cross section and extends through the through bore 14 in the bearing block 12 and in the interior of the nozzle lance 16. The rotary shaft 42 is borne to rotate in the bearing block 12 by means of a rotary bearing 44 which is arranged in the portion 14*c* of the through bore 14. A drive end 46 of the rotary shaft 42 is accessible from outside, at the side of the outer face 12*b* of the bearing block 12, and may be connected there to a drive/gearing unit (not themselves shown here).

At the opposite end to the drive end 46, the rotary shaft 42 tapers to a coupling end 48, where it carries a directing body 50.

Figure 3:
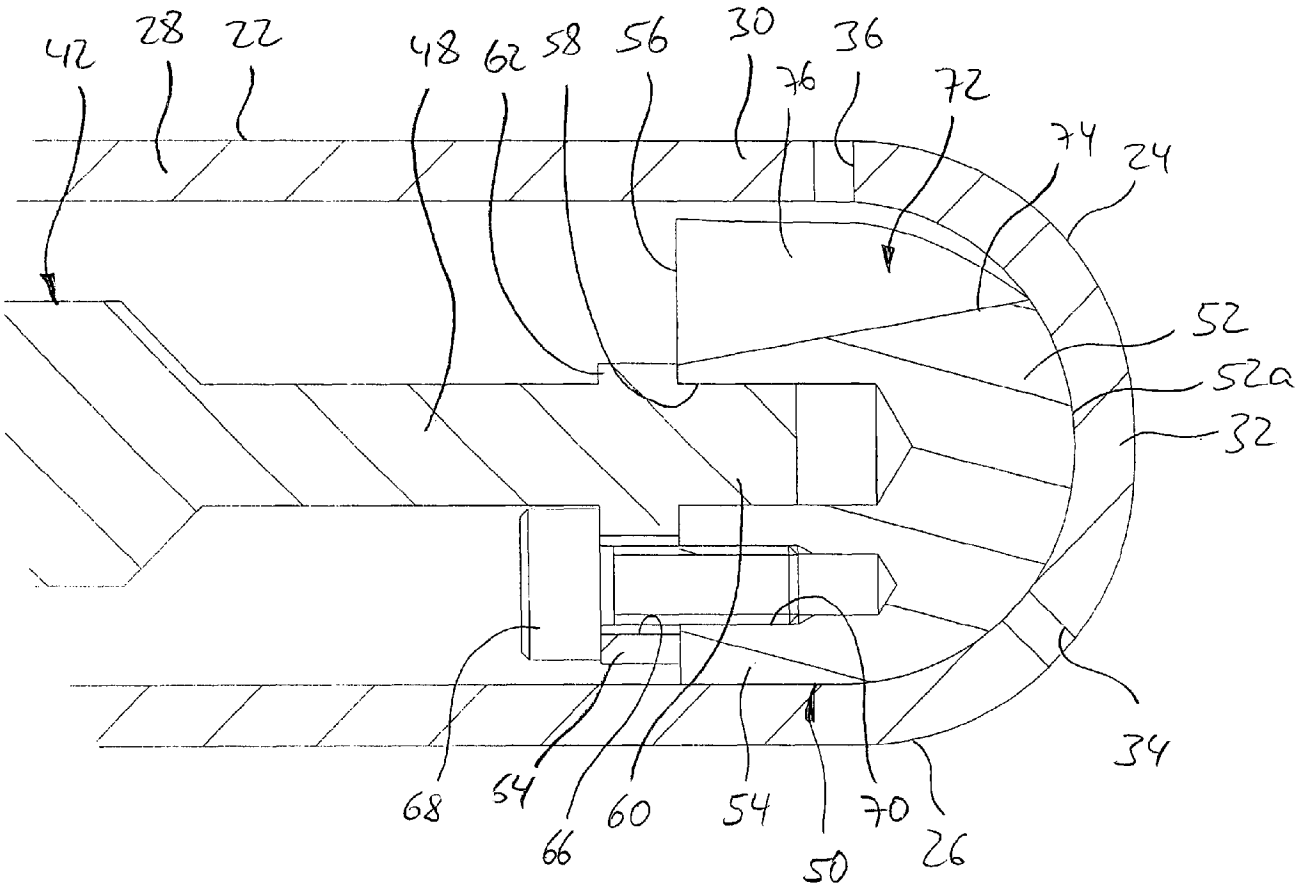
FIG. 3 shows the head portion with directing body and a rotary shaft carrying the latter, in a section from FIG. 2, on a larger scale.

The directing body 50 is shown in detail in FIG. 3 and includes a hemispherical end portion 52 having a hemispherical end face 52*a* whereof the shape complements the inner face of the hemispherical end wall 32 of the head portion 24. The directing body 50 is arranged in the head portion 24 of the nozzle lance 16 such that its end portion 52 abuts against the inner face of the hemispherical end wall 32 of the head portion 24. In the direction of the bearing block 12, the hemispherical end portion 52 of the directing body 50 merges into a cylindrical portion 54, whereof the external contour complements the internal face of the cylindrical wall portion 30 of the head portion 24 and which ends in a base face 56 perpendicular to the longitudinal axis thereof.

Made in this base face 56 is a receiver 58 whereof the shape complements the free tip 60 at the coupling end 48 of the rotary shaft 42, and this tip 60 projects into the depression 58. Provided at the coupling end 48 of the rotary shaft 42 there is moreover a peripheral collar 62 against which the directing body 50 abuts and which limits the depth to which the free tip 60 of the rotary shaft 42 penetrates into the depression 58 in the directing body 50.

Figure 5:
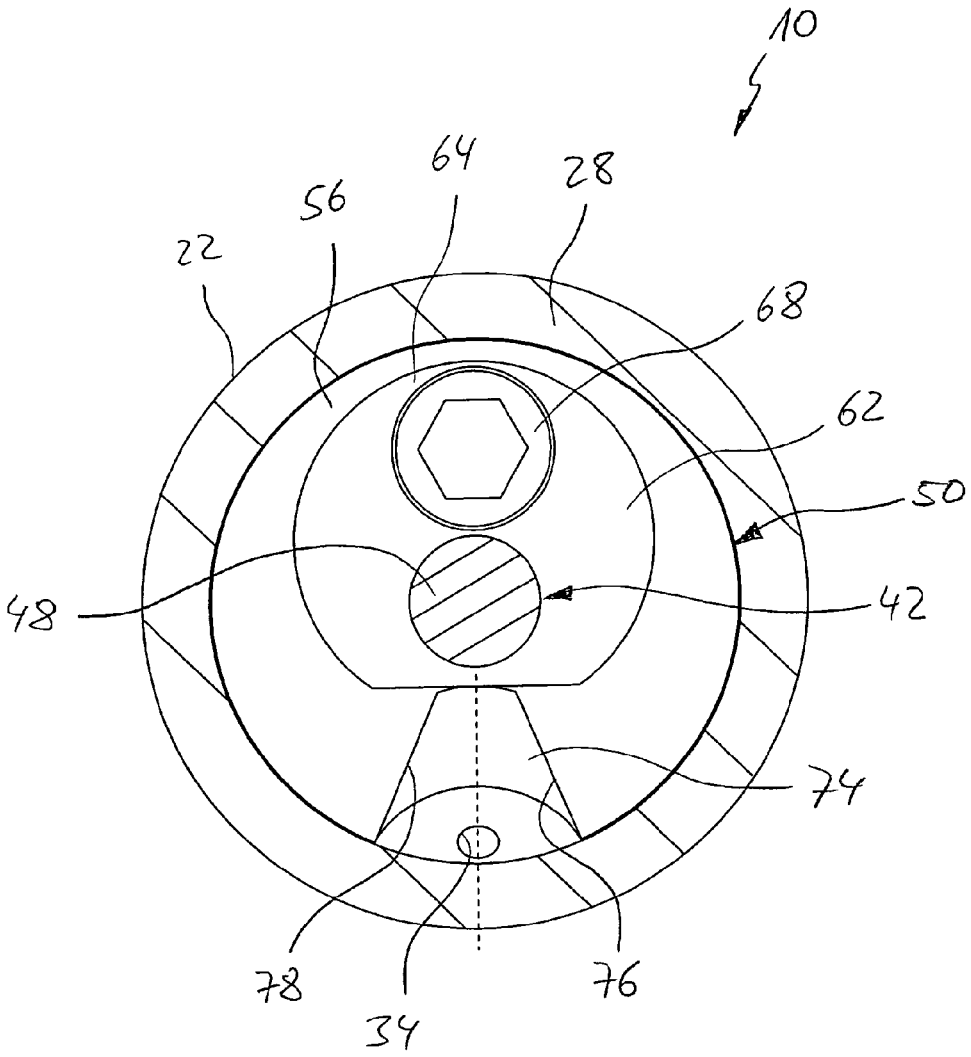
FIG. 5 shows a section through the nozzle arrangement along the line of section V-V from FIG. 4.

The collar 62 is not rotationally symmetrical with the longitudinal axis of the rotary shaft 42 in its construction, and includes a carrying portion 64 (cf. also FIG. 5) having a through bore 66. A threaded screw 68 is guided through the latter and engages in a complementary threaded bore 70 in the directing body 50, as a result of which the latter is coupled to the rotary shaft 42. When the rotary shaft 42 is turned about its longitudinal axis the directing body 50 follows this rotary movement.

Between the base face 56 and the hemispherical outer face 52*a* of the directing body 50 there extends a flow groove 72 whereof the curved groove base 74 extends obliquely radially outwards towards the hemispherical outer face 52*a* of the directing body 50. The groove walls 76 and 78 are inclined radially outwards in relation to a centre plane of the flow groove 72 (indicated as a dotted line in FIG. 5). The flow groove 72 creates a flow channel through the directing body 50.

Between the internal face of the shaft portion 22 of the nozzle lance 16 and the rotary shaft 42 there is a charging space in the form of an annular space 80 which communicates with the feed line 38 and can be charged with a mixture of compressed air and wax. The middle portion 14*c* of the through bore 14 in the bearing block 12 is sealed off from this annular space 80 in fluid-tight manner by means of a seal 82.

The nozzle arrangement 10 described above operates as follows:

For use, the nozzle arrangement 10 is secured to an application robot in a manner known per se. Typically, six-axis application robots are used. The connection point 40 of the feed line 38 is connected to the above-mentioned mixing chamber in which a mixture of compressed air and wax can be generated. The drive end 46 of the rotary shaft 42 is connected to the motor/gearing unit such that the rotary shaft 42 can be turned about its longitudinal axis in both directions of rotation. Because of the degrees of freedom of movement of the application robot, the nozzle arrangement 10 may also be turned as a whole about its longitudinal axis.

The nozzle lance 16 is then inserted into the cavity in a vehicle body into which an anticorrosion wax is to be introduced.

The mixture of compressed air and wax may be dispensed through the two dispensing openings 34 and 36 in the head portion 24 of the nozzle lance 16 in a principal direction corresponding to the direction of the longitudinal axis of the respective dispensing opening 34 and 36. Typically, a cone of dispensing will form about the respective longitudinal axis.

If the geometry of the cavity makes it necessary for the nozzle lance 16 to dispense the mixture of compressed air and wax in a principal direction perpendicular to its longitudinal axis, the rotary shaft 42 is turned by means of the motor/gearing unit until the flow groove 72 in the directing body 50 assumes a position in which the second dispensing opening 36 communicates with the annular space 80 in the nozzle lance 16 by way of the flow groove 72. The corresponding position of the rotary shaft 42 and the directing body 50 can be seen in FIGS. 2 and 3.

The mixture of compressed air and wax is now generated in the mixing chamber and flows through the feed line 38 into the annular space 80 of the nozzle lance 16 and into the flow groove 72 in the directing body 50, and from there is dispensed outwards through the second dispensing opening 36 in the head portion 24 of the nozzle lance 16.

Figure 4:
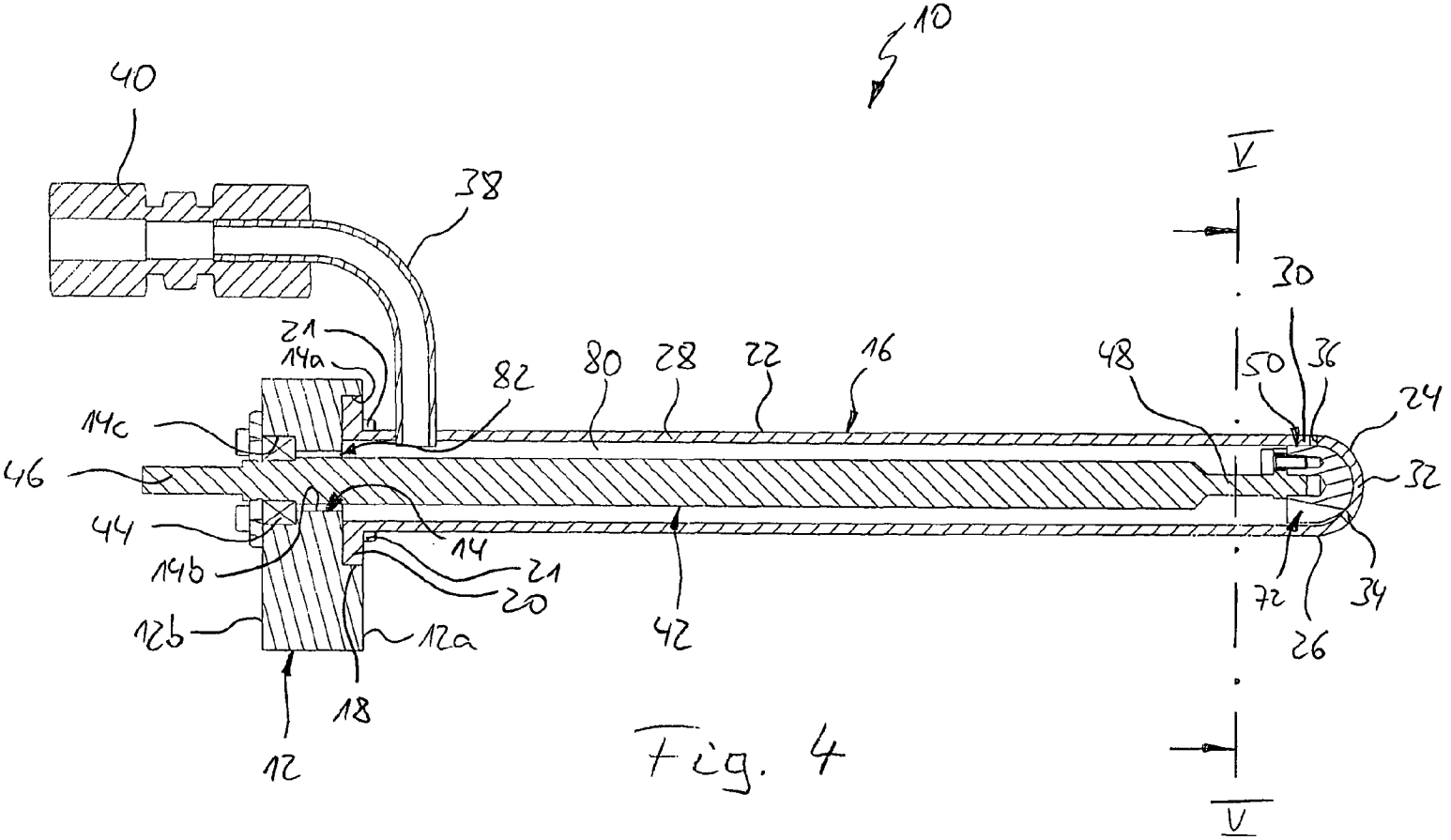
FIG. 4 shows a section through the nozzle arrangement corresponding to FIG. 2, wherein the directing body is shown in a second position.

If, by contrast, the geometry of the cavity makes it more favourable for the nozzle lance 16 to dispense the mixture of compressed air and wax forwards in a principal direction at an angle of 45° to its longitudinal axis, the rotary shaft 42 is turned by means of the motor/gearing unit until the flow groove 72 in the directing body 50 assumes a position in which the first dispensing opening 34 communicates with the annular space 80 in the nozzle lance 16 by way of the flow groove 72. The corresponding position of the rotary shaft 42 and the directing body 50 can be seen in FIGS. 4 and 5.

The flow path of the mixture of compressed air and wax, and hence of the actual coating material in the form of the wax, from the mixing chamber can thus be adjusted by means of the directing body 50 such that it leads optionally to the first dispensing opening 34 or the second dispensing opening 36.

If the robot arm turns the nozzle arrangement 10 as a whole about its longitudinal axis, the mixture of compressed air and wax is distributed in the peripheral direction around the nozzle lance 16, in the respective cavity.

If the local conditions permit, any change required in the direction for dispensing the mixture of compressed air and wax in relation to the cavity in the vehicle body may be achieved by changing the position of the nozzle lance 16 by performing a corresponding control of the robot arm.

In the present exemplary embodiment, two dispensing openings 34 and 36 are provided in the head portion 24 of the nozzle lance 16, arranged at a predetermined and invariable position in relation to one another. In a variant, it is also possible for further such dispensing openings to be provided in one and the same nozzle lance 16 and for these to be capable of communicating with the flow groove 72 of the directing body 50 as a function of the position of the latter. It is also possible for the longitudinal axes of the dispensing openings to form angles other than 90° or 45° with the longitudinal axis of the nozzle lance 16, with the result that the principal direction in which the mixture of compressed air and wax is dispensed through a particular dispensing opening can be changed.

The nozzle lance 16 and in particular the head portion 24 thereof may be customised, by providing an appropriate number of dispensing openings and by arranging them in relation to a plurality of different cavities in a particular vehicle body for treatment.

In this way, it is possible for the nozzle lance 16 to be utilised for application to different cavities in a vehicle body which have different geometries. It is thus possible to dispense with the replacement of an application nozzle—as was necessary hitherto—if, after a first cavity, a cavity different therefrom is to be provided with wax.

As a variant, the directing body 50 includes not only the one flow groove 72 but also at least one further flow groove. In a corresponding arrangement of two flow grooves in the directing body 50, it is thus possible for example for the mixture of compressed air and wax to be dispensed simultaneously through the dispensing openings 34 and 36 of the nozzle lance 16 as a function of the position of the directing body 50, but also as an option for it to be dispensed only through the first dispensing opening 34 or only through the second dispensing opening 36.

Instead of, or in addition to, one or more flow grooves, it is also possible to provide one or more passages in the directing body 50 which start from its base face 56 and extend such that they open into an associated dispensing opening in the nozzle lance 16, as a function of the position of the directing body 50.

As already mentioned above, instead of the dispensing openings 34 and 36 of circular cross section it is also possible to provide dispensing openings having other cross sections. For example, one or more dispensing slots or elongate dispensing holes, through which the mixture of compressed air and wax may be dispensed in a fan shape, may be provided in the head portion 24 of the nozzle lance 16. Overall, the nozzle lance 16 may have any number of dispensing openings, and similarly the cross section of these may take any form. Thus, it is also possible to combine different geometries with one another to give a cross section—such as a cross section in the shape of a keyhole—and dispensing openings may be arranged at different spacings from one another. In this way it is possible to adapt individually to a vehicle body for treatment, or to the cavities therein.

In the exemplary embodiment described above, the head portion 24 of the nozzle lance 16 is substantially hemispherical. However, other geometries having rotational symmetry in relation to the longitudinal axis are also possible. Thus, the head portion of the nozzle lance 16 may for example be conical or in the shape of a truncated cone.

Figure 6:
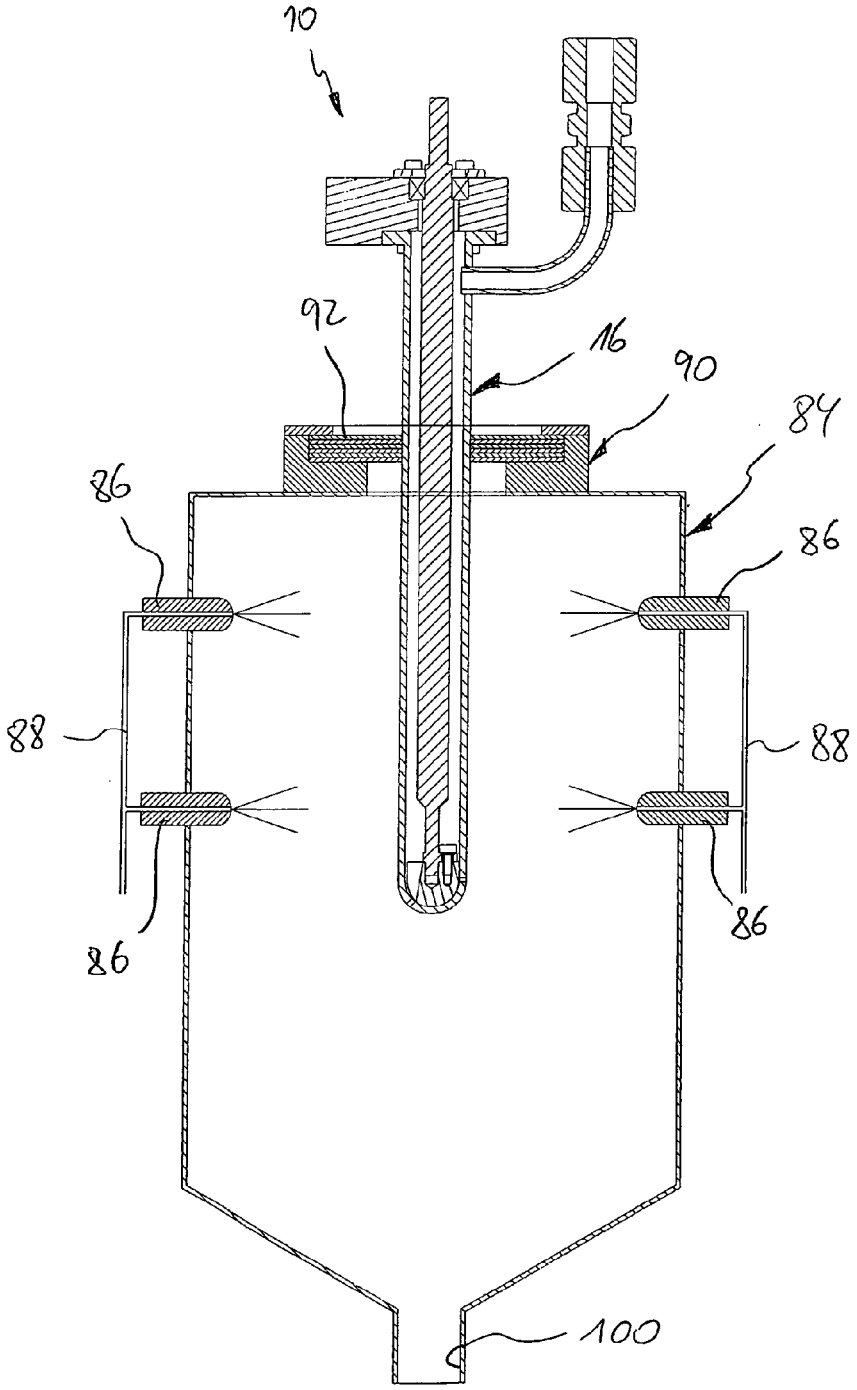
FIG. 6 shows a longitudinal section through a cleaning container for cleaning the nozzle lance, having a leaf-type cover, wherein the nozzle arrangement from FIGS. 1 to 5 is also shown.
Figure 8:
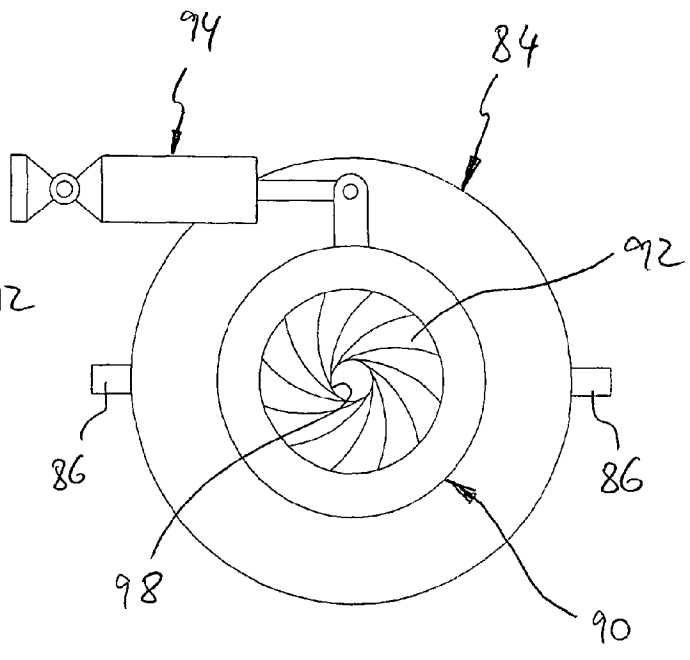
FIG. 8 shows a view, corresponding to FIG. 7, of the cleaning container, wherein the leaves adopt a scraping position.
Figure 7:
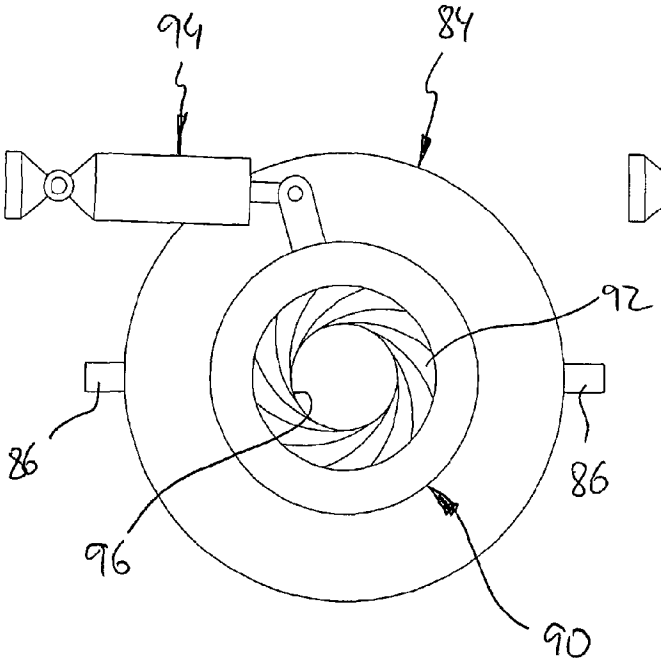
FIG. 7 shows a view from above of the cleaning container from FIG. 6, wherein leaves expose a penetration opening.

After a certain period of operation, wax residues adhere to the outer face of the nozzle lance 16 and may impair proper functioning of the nozzle arrangement 10. To clean the nozzle lance 16, it may for example be dipped in a cleaning liquid in a container 84, as shown in FIGS. 6 to 8. In FIG. 6, of the nozzle arrangement 10 only the nozzle lance 16, shown there as though transparent, is provided with a reference numeral, for the sake of clarity.

The container 84 is moreover provided with spray nozzles 86 which are connected by way of lines 88 to a source (not itself shown here) for cleaning agent and by means of which cleaning agent may be applied to the nozzle lance 16.

Wax residues adhering to the outside of the nozzle lance 16 may, as an alternative or in addition, also be scraped mechanically off the nozzle lance 16. To this end, the container 84 includes a leaf-type cover 90 having leaves 92 in the manner of an iris shutter, of which only one is provided with a reference numeral in FIGS. 6 to 8. The leaf-type cover 90 is controlled by means of a pneumatic cylinder 94 (cf. FIGS. 7 and 8).

For cleaning of the nozzle lance 16, the latter is pushed through a penetration opening 96 that remains between the retracted leaves, with the leaves 92 being retracted far enough not to come into contact with the nozzle lance 16 (cf. FIG. 7). Then the leaves 92 are moved towards the nozzle lance 16 and into a scraping position until they are in contact with it and a scraping opening 98 remains between the leaves 92 (cf. FIG. 8). Then the nozzle lance 16 is moved back again, with the leaves 92 mechanically scraping off wax adhering to the outer face of the nozzle lance 16.

The container 84 has a drainage opening 100 in its base, through which cleaning agent and wax residues can drain. If cleaning agent is to be provided to a certain level in the container 84, the drainage opening 100 is closed off, for example by means of a plug.

The cleaning may be performed at the site of the application without the nozzle lance 16 having to be replaced. This is possible in particular because of the construction of the nozzle arrangement 10, which overall is slender and takes up little space.

Figure 9:
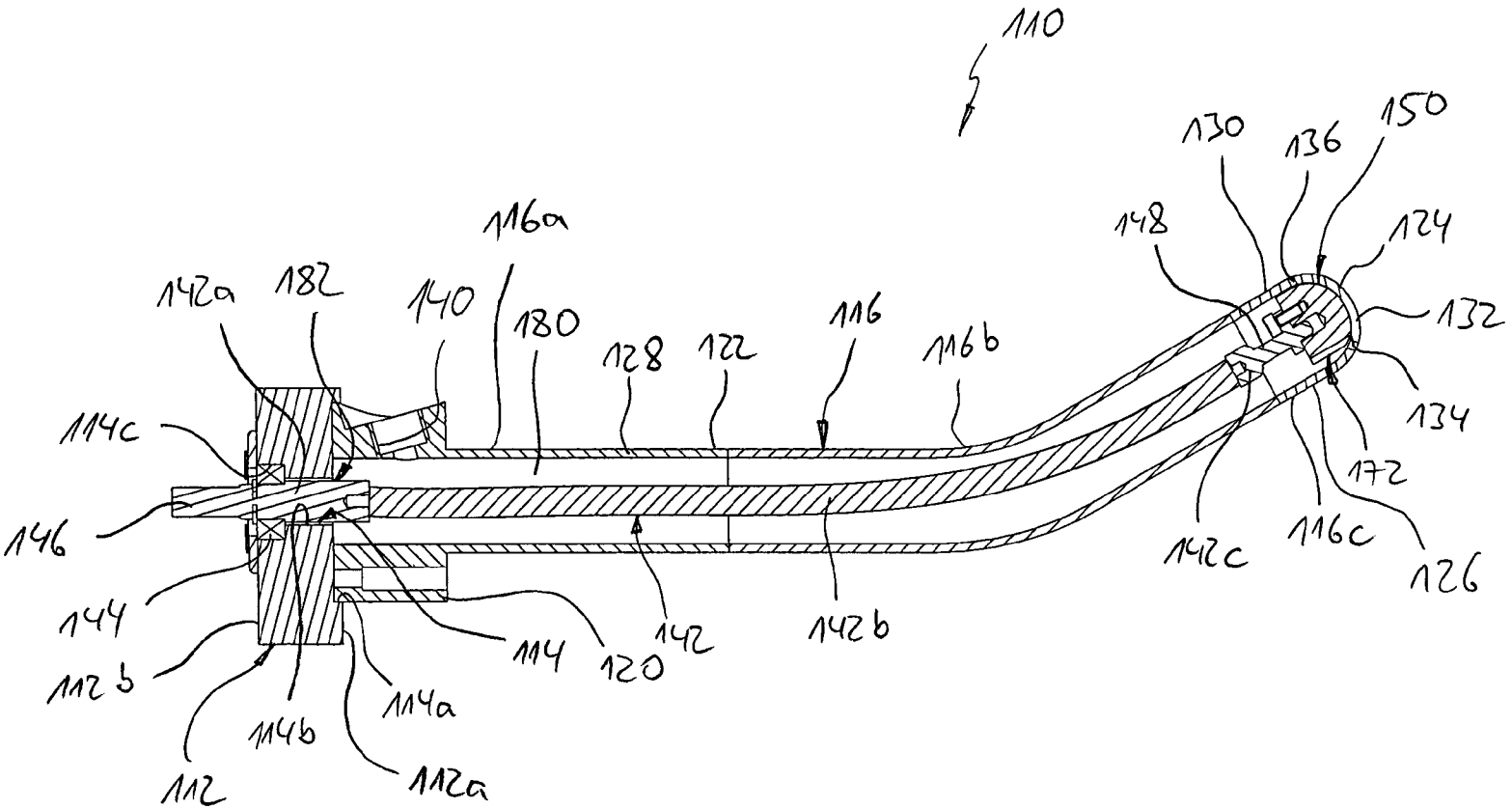
FIG. 9 shows a section, corresponding to FIGS. 2 and 4, of a second exemplary embodiment of a nozzle arrangement having a curved nozzle lance.

FIG. 9 shows, as a further exemplary embodiment, a nozzle arrangement 110. In FIG. 9, components corresponding to those of the nozzle arrangement 10 in FIGS. 1 to 5 are designated by the same reference numerals plus 100. Unlike the rectilinear nozzle lance 16 of the nozzle arrangement 10, the nozzle lance 116 of the nozzle arrangement 110 includes a curvature. As a result of this, the nozzle lance may where necessary be even better adapted to a cavity for treatment in a vehicle body.

The nozzle lance 116 is composed of three individual parts 116*a*, 116*b* and 116*c*, the part 116*c* forming the head portion 124 of the nozzle lance 116. By way of example, the parts 116*a*, 116*b* and 116*c* may be welded to one another. The securing flange 120 of the nozzle lance 116 is of thicker construction than the securing flange 20 of the nozzle lance 16 and projects into the portion 114*a* of the through bore 114 in the bearing block 112 only in certain regions.

There is no feed line from the shaft portion 122 of the nozzle lance 116. Rather, the shaft portion 122 of the nozzle lance 116 includes the connection point 140 which is accessible from outside, for connection to the mixing chamber (which is not itself shown).

The rotary shaft 142 includes three mutually connected portions 142*a*, 142*b* and 142*c*. The portion 142*a* forms the drive end 116 of the rotary shaft 142, which projects outwards through the bearing block 112. The middle portion 142*b* of the rotary shaft 142, which extends in the interior of the curved nozzle lance 116, is of flexible construction and has a diameter corresponding approximately to the diameter of the coupling end 48 of the rotary shaft 42. This has the effect that the middle portion 142*b* of the rotary shaft 142 can follow the curvature of the nozzle lance 116 without coming into contact with the internal face thereof. Finally, the third portion 142*c* of the rotary shaft 142 forms the coupling end 148 thereof.

Otherwise, the statements made above in relation to the nozzle arrangement 10 shown in FIGS. 1 to 5 apply accordingly to the nozzle arrangement 110. This is also true of the cleaning procedure described in connection with FIGS. 6 to 8.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A nozzle arrangement for applying coating material to cavities in articles comprising:

a nozzle element which is connectable to a material source;

a first dispensing opening;

at least one further dispensing opening through which coating material is dispensed;

a directing means which adjusts a flow path of the coating material from the material source such that the flow path leads to the first dispensing opening and/or the at least one further dispensing opening, wherein the directing means is a directing body having an outer face which is arranged in an interior nozzle element and which defines at least one flow channel and establishes different flow paths for the coating material; and a flow groove creates the at least one flow channel through the directing body, wherein the flow groove has a curved and grooved base which extends obliquely radially outwards toward the outer face of the directing body.

2. A nozzle arrangement according to claim 1, wherein the directing body is turnable about an axis of rotation.

3. A nozzle arrangement according to claim 2, wherein the directing body is coupled to a rotary shaft which extends at least in certain regions in the interior of the nozzle element.

4. A nozzle arrangement according to claim 3, wherein the rotary shaft is flexible at least in certain regions.

5. A nozzle arrangement according to claim 1 wherein the nozzle element defines a charging space to which coating material is fed and which communicates with the directing means.

6. A nozzle arrangement according to claim 1 wherein the nozzle element is an elongate nozzle lance.

7. A nozzle arrangement according to claim 6, wherein the nozzle lance is rectilinear.

8. A nozzle arrangement according to claim 6, wherein the nozzle lance is curved.

9. A nozzle arrangement according to claim 1, wherein the dispensing openings are constructed such that the coating material may be dispensed from the nozzle element in different principal directions.

10. A nozzle arrangement according to claim 1, wherein at least one dispensing opening has a circular cross section.

11. A nozzle arrangement according to claim 1, wherein at least one dispensing opening has an elliptical, rectangular, square, triangular, five-sided or hexagonal cross section or a cross section having more than six sides.

12. A nozzle arrangement according to claim 1, wherein at least one of the dispensing openings is slot-shaped or takes the form of an elongate hole.

13. A nozzle arrangement according to claim 1, wherein at least two dispensing openings having different cross sections are joined into a combined dispensing opening.

14. A nozzle arrangement according to claim 1, wherein the dispensing openings have different cross sections.

* * * * *